US006079174A

United States Patent [19]

Williams et al.

[11] Patent Number: 6,079,174

[45] Date of Patent: Jun. 27, 2000

[54] WALL PANEL HAVING MOVABLE CAP

[75] Inventors: Charles E. Williams, Delavan; James M. Durand, Janesville; Yale Shea, Hales Corners, all of Wis.

[73] Assignee: Hufcor, Inc., Janesville, Wis.

[21] Appl. No.: 09/205,933

[22] Filed: Dec. 4, 1998

[51] Int. Cl.[7] ..... E04H 6/00; E04H 14/00

[52] U.S. Cl. ..... 52/243.1; 52/243.1; 52/126.3; 52/126.4; 52/64; 52/71; 52/693; 52/694

[58] Field of Search ..... 52/243.1, 126.3, 52/126.4, 64, 71, 693, 694

[56] References Cited

U.S. PATENT DOCUMENTS

| | | | |
|---|---|---|---|
| 3,042,960 | 7/1962 | Spork . | |
| 3,302,691 | 2/1967 | Andrews et al. . | |
| 3,879,799 | 4/1975 | Williams . | |
| 4,103,463 | 8/1978 | Dixon | 52/122 |
| 4,658,878 | 4/1987 | Williams . | |
| 5,038,534 | 8/1991 | Pollock | 52/126.4 |

FOREIGN PATENT DOCUMENTS

| | | |
|---|---|---|
| 753056 | 3/1933 | France . |

*Primary Examiner*—Carl D. Friedman
*Assistant Examiner*—Dennis L. Dorsey
*Attorney, Agent, or Firm*—Michael Best & Friedrich LLP

[57] ABSTRACT

A vertical movement accommodating apparatus for use with a wall panel includes a cap mounted on a ceiling structure of a room, and a support assembly mounted on a top edge of the wall panel and at least partially disposed within the cap for vertical movement with respect to the cap. The cap is a U-shaped member opening down. The support assembly includes an upper rail, a lower rail, and a truss assembly interconnecting the upper and lower rails. A sealing member is disposed between the upper rail and the cap to provide a sound reducing seal therebetween. The lower rail defines a channel in which a roller mounted on the upper edge of the wall panel is allowed to roll in the longitudinal direction.

30 Claims, 3 Drawing Sheets

50
62
74
82
74
78
90
86
78
90
134
142
144
130
144
134
142
138
130
138
30
126
66
128
110
98
102
106
98
102

WALL PANEL HAVING MOVABLE CAP

FIELD OF THE INVENTION

The invention relates to partition wall panels.

BACKGROUND

Prior art partition wall panels are typically suspended from a track that is mounted on the ceiling structure of a room. Such wall panels are also mounted in a track in the floor, rested on the floor, or otherwise contact the floor of the room. Typically a sealing member is disposed between the lower edge of the panels and the floor. Movement of the ceiling structure of the room relative to the floor of the room (e.g., when snow accumulates on the roof of the building or when the ceiling heats and cools) can cause the panel to be compressed between the floor and the ceiling structure, causing damage to the panel or to the tracks. Otherwise movement of the ceiling structure may cause the panels to be lifted off the floor, thereby breaking the seal between the panels and the floor. The support assembly for prior art partition wall assemblies usually includes members that are welded together.

SUMMARY

The invention provides a free-standing wall panel system comprising a cap adapted to be mounted on a ceiling structure of a room, and extending in a longitudinal direction; a wall having a top edge and a bottom edge; and a top support assembly in telescoping relationship with the cap. The cap and the top support assembly substantially prevent movement of the top edge of the wall transverse to the longitudinal direction in a horizontal plane. Also, the top edge of the wall and the top support assembly are movable with respect to the cap in a substantially vertical direction.

In one aspect of the invention, the top support assembly includes a top rail and a bottom rail that are joined by a truss assembly. In this configuration, the top rail is received within a portion of the cap, and is movable within the cap in a substantially vertical direction. A sealing member may be provided between the cap and the top rail to limit sound passing through the partition wall. The truss assembly may comprise a plurality of truss members fastened to the top and bottom rails with fasteners. The bottom rail may include a track in which roller members mounted on the top edge of the wall roll in the longitudinal direction.

In another aspect of the invention, a guide member may be mounted on the cap and extend through a portion of the top support assembly to ensure substantially vertical relative movement between the top support assembly and the cap. The guide member may be, for example, a bolt. The guide member may pass through a plurality of slots or apertures in the top support assembly. The top support assembly may also be provided with a plurality of fingers that abut the guide member.

In another aspect of the invention, the truss members of the truss assembly are provided with a predetermined amount of camber. The top and bottom rails may also be provided with a pre-determined amount of camber. The amount of camber for the truss members and the top and bottom rails is calculated based on the magnitude of loads expected to be applied to the truss assembly. If the loads exerted on the truss assembly are the same as the calculated loads, the truss members and the top and bottom rails straighten out. In this state, the top and bottom rails are parallel to each other and are each disposed in a substantially horizontal plane.

When unexpected loads are applied to the truss assembly, the wall panel system may exhibit some sag. In prior art partition wall assemblies having welded truss assemblies, such sag is difficult to correct. It is another aspect of the current invention that the camber in the truss members may be adjusted to offset sag in the wall panel system

DETAILED DESCRIPTION

Figure 1:
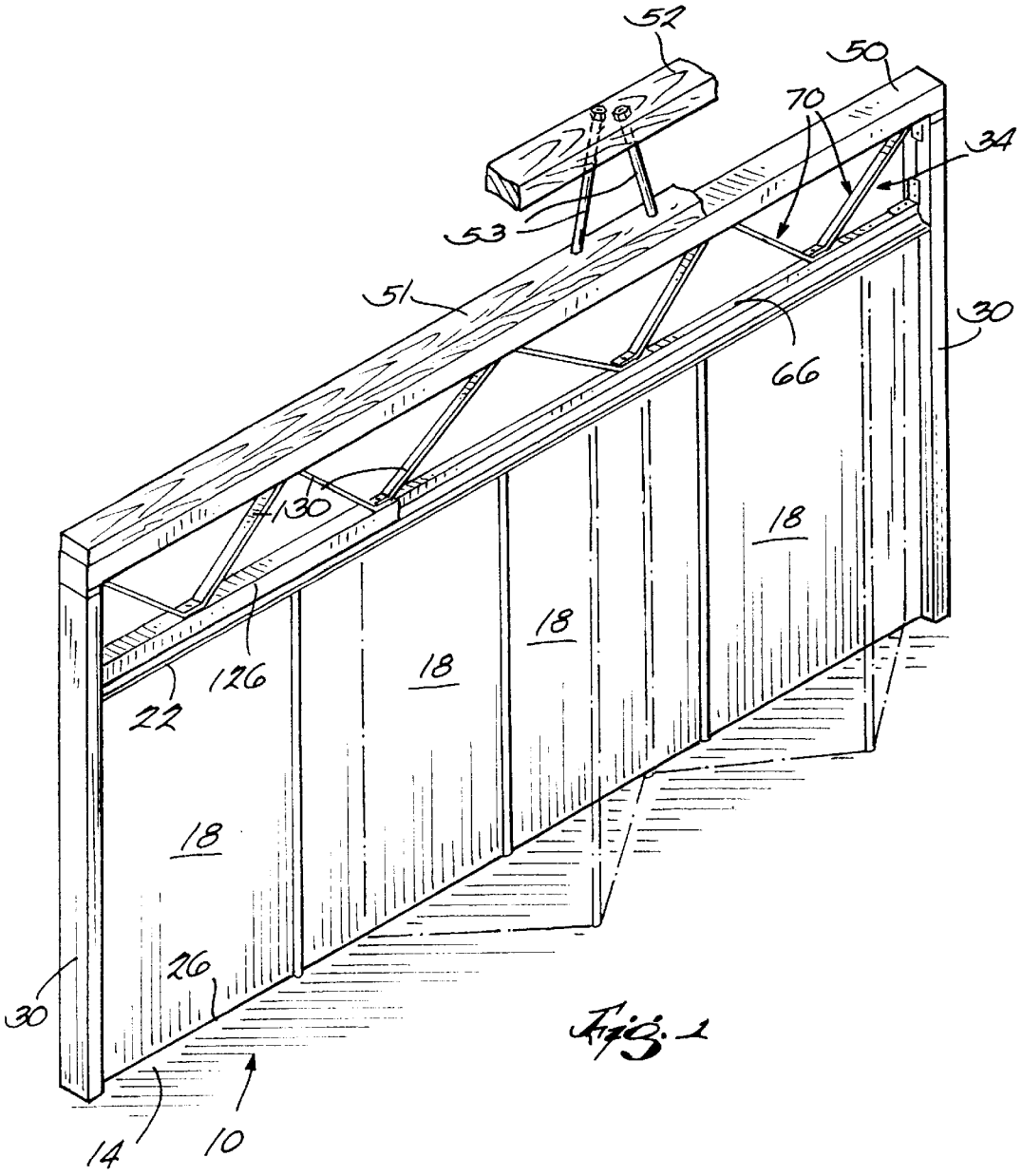
FIG. 1 is a perspective view of a partition wall in a room.

FIG. 1 illustrates a partition wall 10 set up in a room having a floor 14 and a ceiling structure. The partition wall 10 includes a plurality of panels 18, and is foldable and movable with respect to the floor 14 and the ceiling structure as shown in phantom. Each panel 18 includes a top edge 22 and a bottom edge 26 adjacent the floor 14. Vertical end supports 30 are mounted on the floor 14, and support a top support assembly 34 that is interconnected with the top edge 22 of the panels 18.

As used herein, "ceiling structure" means the roof deck or ceiling and all beams and other structural components of the roof deck or ceiling, including pipes and ducts. The cap 50 is suspended from the ceiling structure by various methods, including direct mounting to the ceiling structure, and through an intermediary structure such as lumber, a header, or other suitable means. The illustrated means for suspending the cap 50 from the ceiling structure includes a mounting beam 51 mounted on a ceiling beam 52 with long bolts 53. The illustrated mounting beam 52 is a wooden board (e.g., a 2×6 board) extending longitudinally across the room.

The illustrated cap is a U-shaped channel opening downwardly. The cap 50 includes an enclosed channel 54 having longitudinally-spaced apertures through which a guide member 58 may be inserted. The illustrated guide member 58 is a bolt that is secured to the enclosed channel 54 with nuts. Other guide members 58, including rigid tubes having round or polygonal cross-sections, are within the scope of the invention. Also, the guide member 58 may be mounted on the cap 50 by many other suitable means, such as welding, fastening with fasteners, and inserting an enlarged portion of the guide member 58 in a slot.

The top support assembly 34 includes a top rail 62, a bottom rail 66, and a truss assembly 70 interconnecting the top rail 62 with the bottom rail 66. The illustrated top rail 62 includes a pair of vertical side flanges 74, a pair of vertical central webs 78, a pair of top horizontal webs 82, a middle horizontal web 86, and a pair of bottom horizontal flanges 90. The bottom horizontal flanges 90 and the lower portion of the central vertical webs 78 define a channel for facilitating connection of the top rail 62 to the truss assembly 70.

The top rail 62 is sized such that the vertical side flanges 74 are received within the channel of the cap 50. Alternatively, the cap 50 may be received within a portion of the top rail 62 between the flanges 74. Apertures or slots are formed in the middle horizontal web 86 to allow the guide member 58 to pass therethrough. The inner ends of the top horizontal webs 82 and the bottom horizontal flanges 90, as well as the portion of the middle horizontal web 86 that contacts the guide member 58, act as fingers that help ensure substantially vertical movement between the cap 50 and the top support assembly 34.

A sealing member 94 is disposed between the vertical side flanges 74 and the cap 50 to create a sound-reducing seal between the vertical side flanges 74 and the cap 50. The sealing member 94 is preferably made of vinyl, neoprene, or any non-porous flexible material. The sealing member 94 may be mounted on either the top rail 62 or the cap 50, and allows the other of the top rail 62 and cap 50 to slide against the sealing member 94 while maintaining the sound-reducing seal.

Figure 3:
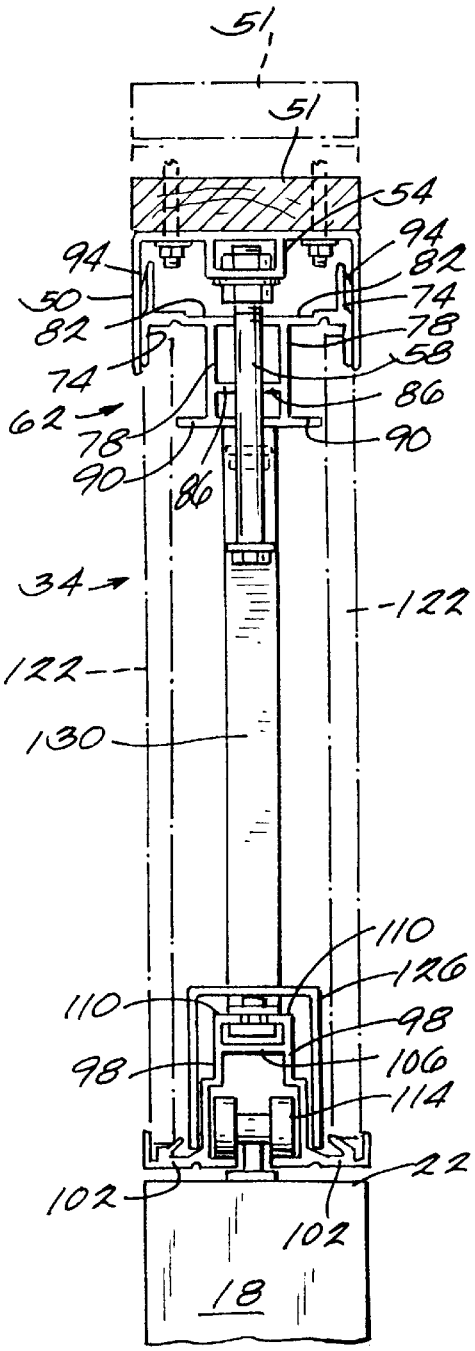
FIG. 3 is an enlarged view of the upper portion of the partition wall with the cap in a lowered position.
Figure 4:
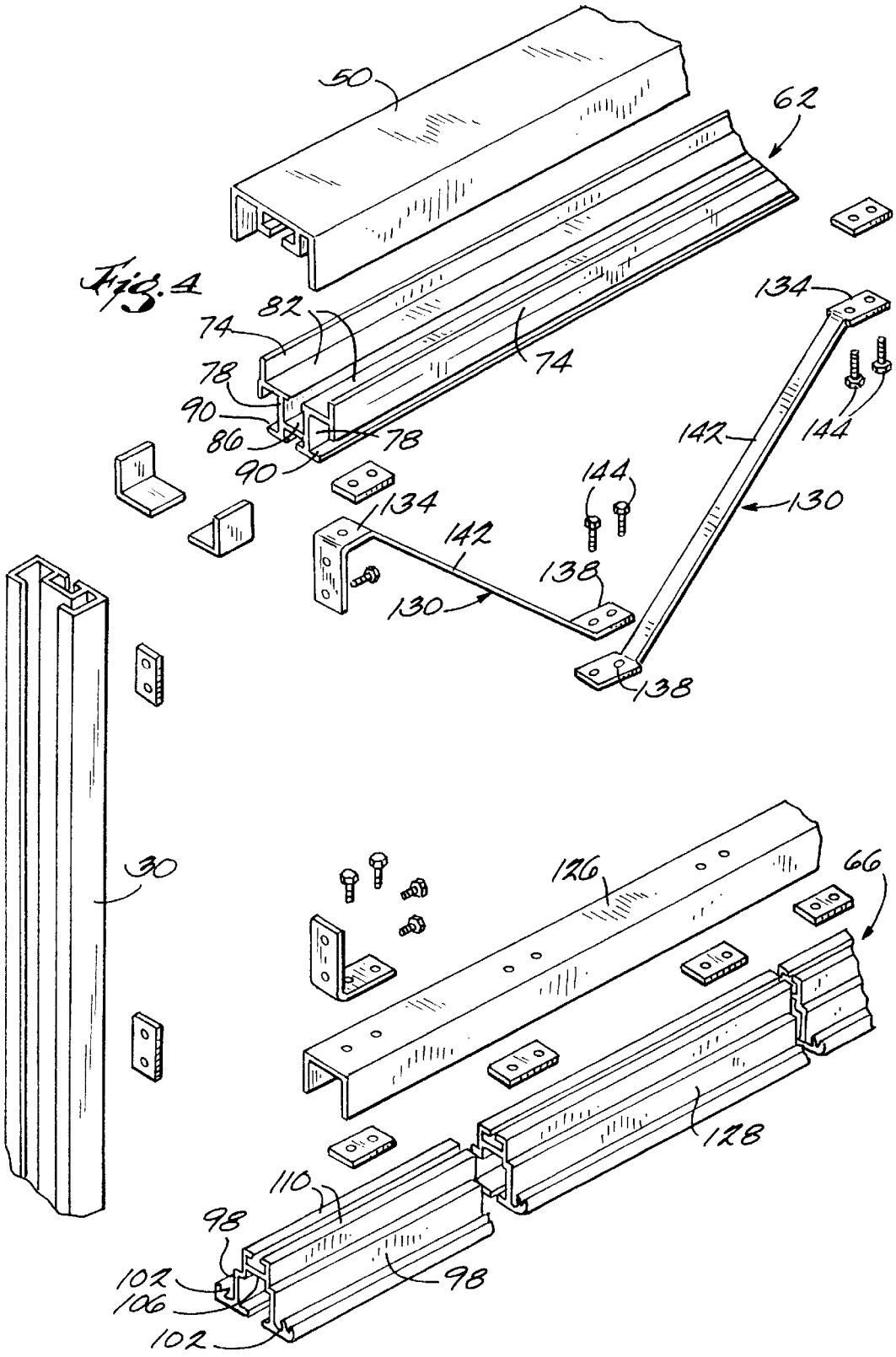
FIG. 4 is an exploded view of the upper portion of the partition wall.

The bottom rail 66 includes a pair of vertical webs 98, a pair of lower horizontal flanges 102, a middle horizontal web 106, and pair of upper horizontal flanges 110. The upper horizontal flanges 110, with the upper portion of the vertical webs 98, define a channel to facilitate connecting the truss assembly 70 to the bottom rail 66. The lower horizontal flanges 102, together with the lower portion of the vertical webs 98, define a channel in which a roller 114 is received. The roller 114 is mounted on the top edge 22 of every panel 18 or every second panel 18. Thus the panels 18 are movable in the longitudinal direction along the channel. The lower horizontal flanges 102 also include tabs 118 for retaining removable panels 122 (shown in phantom in FIG. 3) that fit between the top and bottom rails 62, 66, and that cover the top support assembly 34.

An escapement cover 126 is provided above the bottom rail 66. The escapement cover 126 provides a convenient mounting surface for a removable escapement portion 128 of the bottom rail 66. The escapement portion of the bottom rail 66 may be unfastened from the escapement cover 126 and removed to provide a break in the bottom rail 66 for installation or removal of the panels 18.

The truss assembly 70 includes a plurality of truss members 130. The illustrated truss members 130 include top and bottom flat portions 134, 138, respectively, and an angled portion 142. The top and bottom flat portions 134, 138 include apertures through which fasteners 144 are extended to join the truss assembly 70 to the top and bottom rails 62, 66. The angled portion 142 is angled to suit the spacing provided. Usually the angled portion 142 is angled less than 45° with respect to both the top and bottom rails 62, 66 when installed. In some cases, however, the angled portion 142 is disposed more uprightly between the rails 62, 66 at an angle approaching 90°. The truss members 130 may be provided with some camber to allow the truss assembly 70 to flex to further absorb changes in loading conditions.

The camber provided in the truss members 130 for installation is calculated based on predicted loads for the truss assembly 70. The top and bottom rails 62, 66 may also have some camber prior to assembly of the partition wall 10. When the partition wall 10 is assembled, the loads on the truss assembly 70 straighten out the top rail 62, bottom rail 66, and truss members 130. In some instances, the partition wall 10 may sag under unexpected loads. In such situations, the sag is easily corrected by loosening the bolts 144, adding camber to the truss members 130, and re-tightening the bolts 144. Correcting sag is therefore much simpler than it would be for a welded truss assembly.

Figure 2:
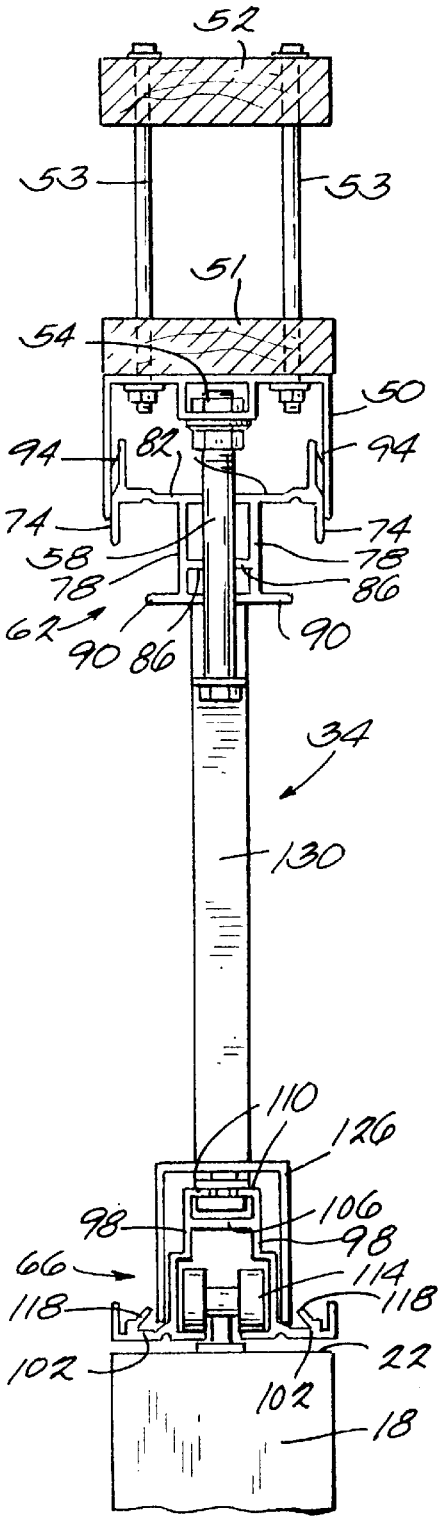
FIG. 2 is an enlarged view of the upper portion of the partition wall with the cap in an intermediate position.

The cap 50 and top support assembly 34 are preferably installed such that the top rail 62 is disposed about halfway into the cap 50 (FIG. 2), or in an intermediate position. From this position, the ceiling structure and cap 50 may move down toward the floor 14 (illustrated in solid lines in FIG. 3) and upward away from the floor 14 (illustrated in phantom in FIG. 3) a distance equal to about half the depth of the channel defined by the cap 50. In this regard, the cap 50 and the top support assembly 34 together comprise a vertical movement accommodating assembly that allows the ceiling structure to sag or raise a given amount, and that allows the truss assembly 70 to move in relation to the cap 50, with changing conditions without any effect on the wall panel 18.

Although particular embodiments of the present invention have been shown and described, other alternative embodiments will be apparent to those skilled in the art and are within the intended scope of the present invention. Thus, the present invention is to be limited only by the following claims.

What is claimed is:

1. A wall panel comprising:

a cap adapted to be mounted on a ceiling structure of a room, and extending in a longitudinal direction;

a wall having a top edge and a bottom edge; and a top support assembly having a top rail, a bottom rail, and a truss assembly interconnecting said top rail with said bottom rail, said top support assembly being in telescoping relationship with said cap, such that said cap and said top support assembly substantially prevent movement of said top edge of said wall transverse to said longitudinal direction in a horizontal plane;

whereby said top edge of said wall and said top support assembly are movable with respect to said cap in a substantially vertical direction.

2. The wall panel of claim 1, wherein said cap member is a generally U-shaped member opening downwardly.

3. The wall panel of claim 1, wherein said top rail is movable within a portion of said cap.

4. The wall panel of claim 1, further comprising a sealing member disposed between said cap and said top rail, said sealing member providing a sound-reducing seal between said cap and said top rail.

5. The wall panel of claim 4, wherein said sealing member is made of a material selected from the group consisting of vinyl and neoprene.

6. The wall pane of claim 5, wherein said sealing member is made of a non-porous flexible material.

7. The wall panel of claim 1, further comprising a guide member mounted on said cap and extending through a portion of said top rail to facilitate substantially vertical movement of said top rail with respect to said cap.

8. The wall panel of claim 7, wherein said guide member is a bolt.

9. The wall panel of claim 7, wherein said guide member extends through three slots in said top rail.

10. The wall panel of claim 7, wherein said top rail further comprises at least one pair of fingers contacting opposite sides of said guide member.

11. The wall panel of claim 10, wherein said at least one pair of fingers comprises three pairs of fingers contacting opposite sides of said guide member.

12. The wall panel of claim 1, further comprising a roller member mounted on said top edge of said wall panel, wherein said bottom rail defines a track in which said roller member rolls when said wall panel is moved in said longitudinal direction with respect to said top support assembly.

13. The wall panel of claim 1, wherein said truss assembly includes a plurality of truss members fastened to said top rail and to said bottom rail with fasteners, and disposed at an acute angle with respect to each of said top and bottom rail.

14. The wall panel of claim 13, wherein said truss members are cambered truss members.

15. The wall panel of claim 14, wherein the camber in said truss members is alterable upon loosening said fasteners, adjusting the camber of said truss members, and re-tightening said fasteners.

16. A support assembly for use on a wall panel, said support assembly comprising:

a cap adapted to be mounted on a ceiling structure of a room, and extending in a longitudinal direction; and a top support assembly including a top rail, a bottom rail, and a truss assembly interconnecting said top rail with said bottom rail, said top support assembly being in telescoping relationship with said cap, said top support assembly adapted to be mounted on a top edge of the wall panel;

whereby said cap and said top support assembly are adapted to substantially prevent movement of the top edge of the wall transverse to said longitudinal direction in a horizontal plane; and whereby said top support assembly is movable with respect to said cap in a substantially vertical direction to accommodate vertical movement of the top edge of the wall panel and the cap with respect to each other.

17. The support assembly of claim 16, wherein said cap member is a generally U-shaped member opening downwardly.

18. The support assembly of claim 16, wherein said top rail is movable within a portion of said cap.

19. The support assembly of claim 16, further comprising a sealing member disposed between said cap and said top rail, said sealing member providing a sound-reducing seal between said cap and said top rail.

20. The support assembly of claim 19, wherein said sealing member is made of a material selected from the group consisting of vinyl and neoprene.

21. The support assembly of claim 19, wherein said sealing member is made of a non-porous flexible material.

22. The support assembly of claim 16, further comprising a guide member mounted on said cap and extending through a portion of said top rail to facilitate substantially vertical movement of said top rail with respect to said cap.

23. The support assembly of claim 22, wherein said guide member is a bolt.

24. The support assembly of claim 22, wherein said guide member extends through three slots in said top rail.

25. The support assembly of claim 22, wherein said top rail further comprises at least one pair of fingers contacting opposite sides of said guide member.

26. The support assembly of claim 25, wherein said at least one pair of fingers comprises three pairs of fingers contacting opposite sides of said guide member.

27. The support assembly of claim 16, adapted to be used with a roller member mounted on the top edge of the wall panel, wherein said bottom rail defines a track adapted to receive the roller member and along which the roller member rolls when the wall panel is moved in said longitudinal direction with respect to said top support assembly.

28. The support assembly of claim 16, wherein said truss assembly includes a plurality of truss members fastened to said top rail and to said bottom rail with fasteners, and disposed at an acute angle with respect to each of said top and bottom rail.

29. The wall panel of claim 28, wherein said truss members are cambered truss members.

30. The wall panel of claim 29, wherein the camber in said truss members is alterable upon loosening said fasteners, adjusting the camber of said truss members, and re-tightening said fasteners.

* * * * *

UNITED STATES PATENT AND TRADEMARK OFFICE

CERTIFICATE OF CORRECTION

PATENT NO : 6,079,174

DATED : June 27, 2000

INVENTOR(S) : Charles E. Williams, James M. Durand, Yale Shea

It is certified that error appears in the above-identified patent and that said Letters Patent are hereby corrected as shown below:

Claim 6, column 4, line 40, delete "claim 5" and insert ---claim 4--.

Signed and Sealed this

Tenth Day of April, 2001

*Attest:*

Nicholas P. Godici

NICHOLAS P. GODICI

*Attesting Officer*

*Acting Director of the United States Patent and Trademark Office*